US010023990B2

(12) United States Patent
Pollett

(10) Patent No.: US 10,023,990 B2
(45) Date of Patent: Jul. 17, 2018

(54) WASHING MACHINE APPLIANCES WITH TEMPERATURE CONTROL FEATURES

(71) Applicant: General Electric Company, Schenectady, NY (US)

(72) Inventor: James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 120 days.

(21) Appl. No.: 15/009,902

(22) Filed: Jan. 29, 2016

(65) Prior Publication Data

US 2017/0218560 A1 Aug. 3, 2017

(51) Int. Cl.

| | |
|---|---|
| ***D06F 39/04*** | (2006.01) |
| ***D06F 39/08*** | (2006.01) |
| ***D06F 35/00*** | (2006.01) |
| ***D06F 33/02*** | (2006.01) |

(52) U.S. Cl.
CPC ..... *D06F 39/045* (2013.01); *D06F 33/02* (2013.01); *D06F 35/006* (2013.01); *D06F 39/088* (2013.01)

(58) Field of Classification Search
CPC ..... D06F 33/00; D06F 33/02; D06F 37/04; D06F 39/045; D06F 39/08; D06F 39/088
See application file for complete search history.

(56) References Cited

U.S. PATENT DOCUMENTS 4,406,401 A * 9/1983 Nettro ..... G05D 23/1393 236/12.12
4,643,350 A * 2/1987 DeSchaaf ..... G05D 23/1393 236/12.12
5,439,019 A * 8/1995 Quandt ..... D06F 39/088 137/2
6,003,182 A * 12/1999 Song ..... D06F 39/088 236/12.12
6,305,610 B1 * 10/2001 Estes ..... D06F 33/02 236/12.12
6,327,730 B1 * 12/2001 Corbett ..... D06F 33/02 134/18
6,499,321 B1 * 12/2002 Rhodes ..... D06F 33/02 68/12.03
6,634,048 B1 * 10/2003 Hornung ..... D06F 39/045 68/12.03

(Continued)

FOREIGN PATENT DOCUMENTS

CH 703489 B1 6/2015

*Primary Examiner* — Joseph L. Perrin
(74) *Attorney, Agent, or Firm* — Dority & Manning, P.A.

(57) ABSTRACT

Washing machine appliances and methods for operating washing machine appliances are provided. A method includes receiving a desired water temperature selection, and causing water to be flowed through a valve assembly to a nozzle, the nozzle operable to flow water into a tub of the washing machine appliance. The method further includes receiving, when the desired water temperature selection is an unregulated water temperature, an initial sensed water temperature from a temperature sensor, and causing the valve assembly to adjust a temperature of the water flowed through the valve assembly when the desired water temperature selection is an unregulated water temperature and the initial sensed water temperature is below a predetermined temperature threshold.

13 Claims, 4 Drawing Sheets

(56) References Cited

U.S. PATENT DOCUMENTS

| | | | | |
|---|---|---|---|---|
| 6,935,142 | B2 * | 8/2005 | Musser | D06F 39/005 29/829 |
| 2008/0276655 | A1 * | 11/2008 | Luckman | D06F 33/02 68/12.12 |
| 2009/0139038 | A1 * | 6/2009 | Lim | D06F 39/008 8/149.3 |
| 2011/0220331 | A1 * | 9/2011 | Fochem | D06F 39/006 165/135 |
| 2012/0304395 | A1 * | 12/2012 | Griswold | D06F 39/087 8/137 |
| 2015/0292138 | A1 * | 10/2015 | Leonard | D06F 39/088 8/137 |

* cited by examiner

WASHING MACHINE APPLIANCES WITH TEMPERATURE CONTROL FEATURES

FIELD OF THE INVENTION

The present disclosure relates generally to washing machine appliances and methods for operating washing machine appliances, and more particularly to temperature control features for washing machine appliances.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

The water flowed into the tub of a washing machine appliance can be at a variety of temperatures, and the desired water temperature is typically selected by a user based on the type of articles being washed and other various factors. For example, a typical washing machine appliance allows a user to select between various regulated water temperatures, including for example a cold water temperature, warm water temperature and hot water temperature. Each of these selectable temperatures is regulated, meaning that water from a cold water source and water from a hot water source are selectively flowed into the tub such that the water in the tub is at a particular predetermined temperature or temperature range.

In some cases, washing machine appliances allow a user to alternatively select an unregulated water temperature for water flowed into the tub. When the unregulated water temperature is selected, water from the cold water source only is flowed into the tub, with no particular predetermined temperature or temperature range required for this water.

While the use of an unregulated water temperature option does provide advantages, such as energy savings, there can be disadvantages to the use of such option. For example, the cold water source is typically a commercial water supply. The temperature of this water can thus be affected by, for example, the ambient environmental temperature. Relatively colder temperatures can result in relatively colder water being supplied to the washing machine appliance when the unregulated water temperature option is selected. However, relatively colder water, such as water that is less than 50-60 degrees Fahrenheit, can have adverse effects on the dispersion of additives (i.e. detergent, bleach, fabric softener, etc.), and thus have adverse effects on the performance of the washing machine appliance.

Accordingly, washing machine appliances which include temperature regulation features, in particular for use when unregulated water temperature options are selected, would be advantageous.

BRIEF DESCRIPTION OF THE INVENTION

In accordance with one embodiment of the present disclosure, a washing machine appliance is provided. The washing machine appliance includes a cabinet, a tub disposed within the cabinet, and a basket disposed within the tub and rotatable relative to the tub about a central axis. The washing machine appliance further includes a nozzle operable to flow water into the tub, and a valve assembly operable to regulate the flow of water to the nozzle, the valve assembly in fluid communication with a hot water source and a cold water source. The washing machine appliance further includes a temperature sensor for sensing a water temperature, a control panel, the control panel including a water temperature selector, and a controller in communication with the valve assembly, the temperature sensor and the water temperature selector. The controller is configured for receiving a desired water temperature selection transmitted by the water temperature selector, and causing water to be flowed through the valve assembly to the nozzle. The controller is further configured for receiving, when the desired water temperature selection is an unregulated water temperature, an initial sensed water temperature from the temperature sensor, and causing the valve assembly to adjust a temperature of the water flowed through the valve assembly when the desired water temperature selection is an unregulated water temperature and the initial sensed water temperature is below a predetermined temperature threshold.

In accordance with another embodiment of the present disclosure, a method for operating a washing machine appliance is provided. The method includes receiving a desired water temperature selection, and causing water to be flowed through a valve assembly to a nozzle, the nozzle operable to flow water into a tub of the washing machine appliance. The method further includes receiving, when the desired water temperature selection is an unregulated water temperature, an initial sensed water temperature from a temperature sensor, and causing the valve assembly to adjust a temperature of the water flowed through the valve assembly when the desired water temperature selection is an unregulated water temperature and the initial sensed water temperature is below a predetermined temperature threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
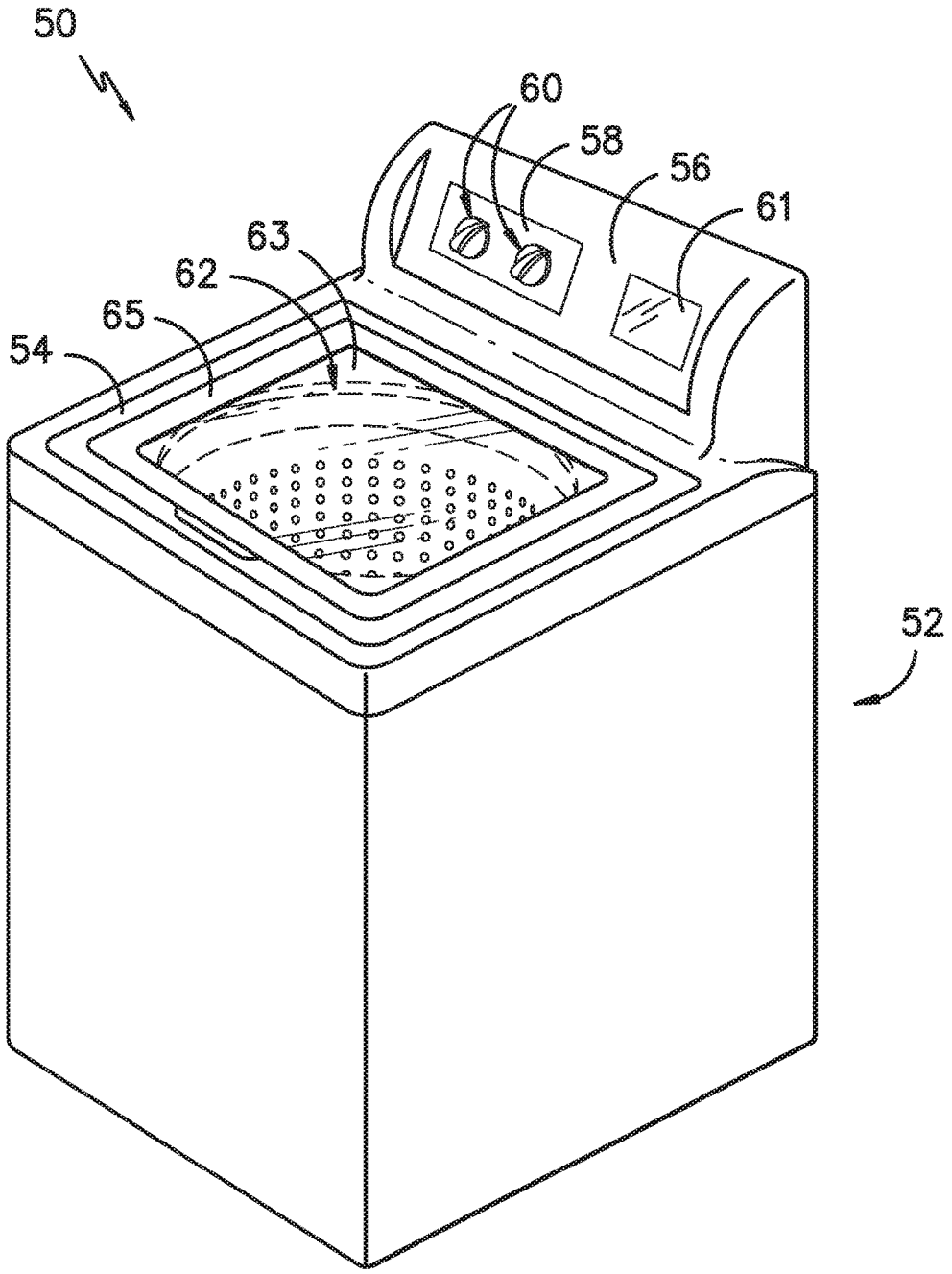
FIG. 1 provides a perspective view of a washing machine appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
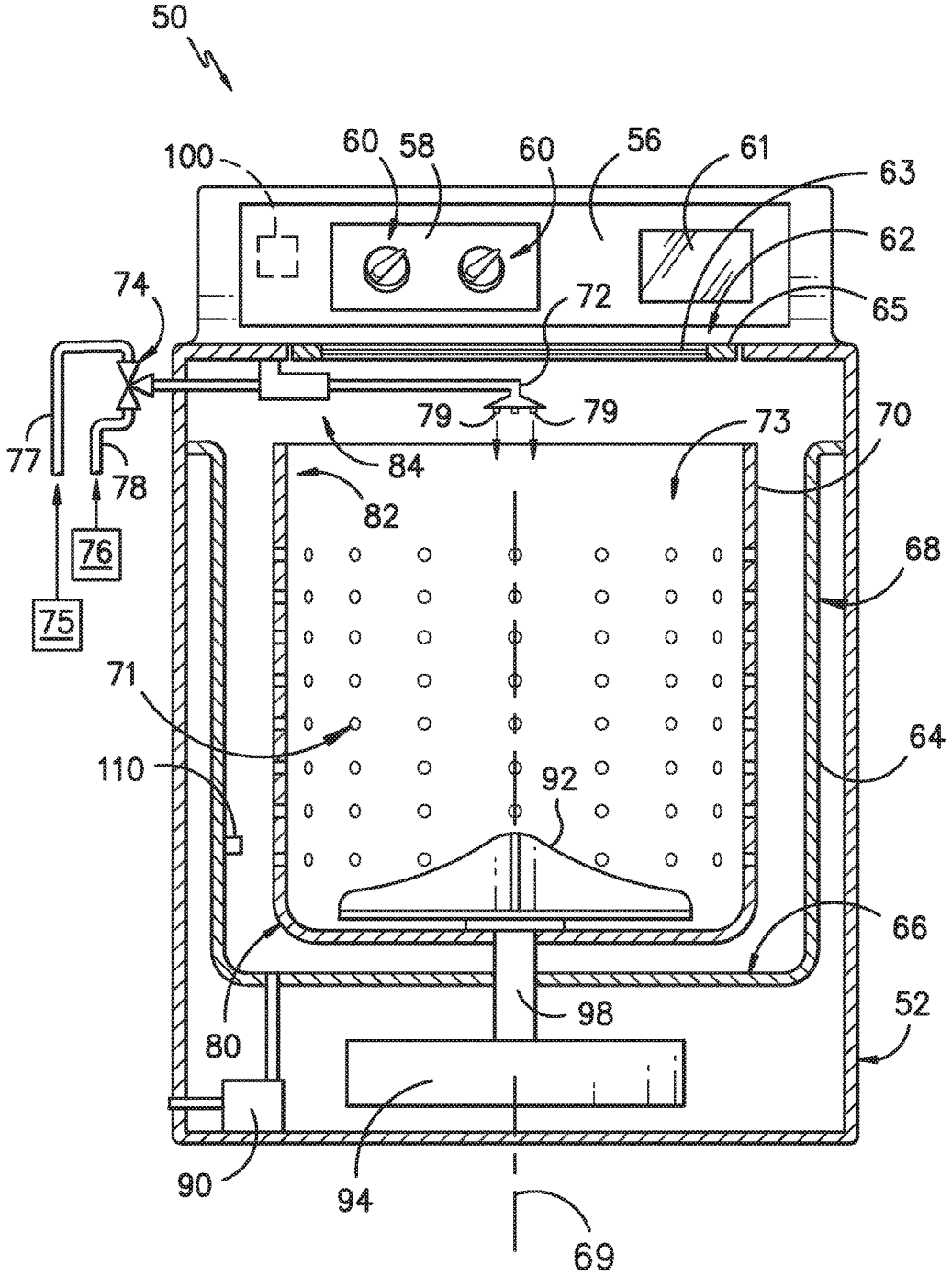
FIG. 2 provides a front, section view of a washing machine appliance in accordance with embodiments of the present disclosure.

FIG. 2 provides a front, cross-section views of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a central axis 69, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A valve assembly 74, which may include one or more valves, regulates the flow of liquid through nozzle 72. For example, valve assembly 74 (and each valve thereof) can selectively adjust between a closed position in order to terminate or obstruct the flow of liquid to and through nozzle 72 and an open position in order to allow the flow of liquid to and through nozzle 72. The valve assembly 74 may be in fluid communication with one or more external liquid sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the valve assembly 74. A cold water conduit 77 and a hot water conduit 78 may supply cold and hot water, respectively, from the sources 75, 76 through valve assembly 74. Valve assembly 74 may further be operable to regulate the flow of hot and cold liquid, and thus the temperature of the resulting liquid flowed into tub 64, such as through the nozzle 72. For example, in some embodiments, valve assembly 74 includes a single valve which is in fluid communication with both the cold water source 75 (via cold water conduit 77) and the hot water source 76 (via hot water conduit 78). In alternative embodiments, valve assembly 74 may include a valve which is in fluid communication with the cold water source 75 (via cold water conduit 77) and a separate valve which is in fluid communication with the hot water source 76 (via hot water conduit 78). In either case, the valve or valves may selectively allow or prevent hot water from hot water source 76 and cold water from cold water source 75 therethrough, such as for particular times and/or at particular ratios, to adjust the temperature of the water that is flowed to and through nozzle 72 into the tub 64.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a temperature sensor 110 can be disposed within the washing machine appliance 50. For example, temperature sensor 110 may be disposed within the tub 64, or in the flow path of water between the valve assembly 74 and the nozzle 72, or in another suitable location. The temperature sensor 110 may be operable to measure the temperature of water flowing into or within the tub 64. Other suitable sensors, such as speed sensors, pressure sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as valve assembly 74, pump assembly 90, motor 94, temperature sensor 110, and other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with liquid, such as water, and may be mixed with detergent to form a wash fluid. Valve assembly 74 can be opened to initiate a flow of liquid and resulting wash fluid into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained, such as through use of pump assembly 90. Laundry articles can then be rinsed by again adding fluid to tub 64. Depending on the particulars of the cleaning cycle selected by a user, agitation element 92 or basket 70 may again provide agitation within basket 70. After a rinse cycle, tub 64 is again drained, such as through use of pump assembly 90. Further, in exemplary embodiments, one or more spin cycles may be performed. In particular, a spin cycle may be applied after the wash cycle(s) and/or after the rinse cycle(s) in order to wring excess wash fluid from the articles being washed. During a spin cycle, basket 70 is rotated at relatively high speeds, as discussed further herein.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
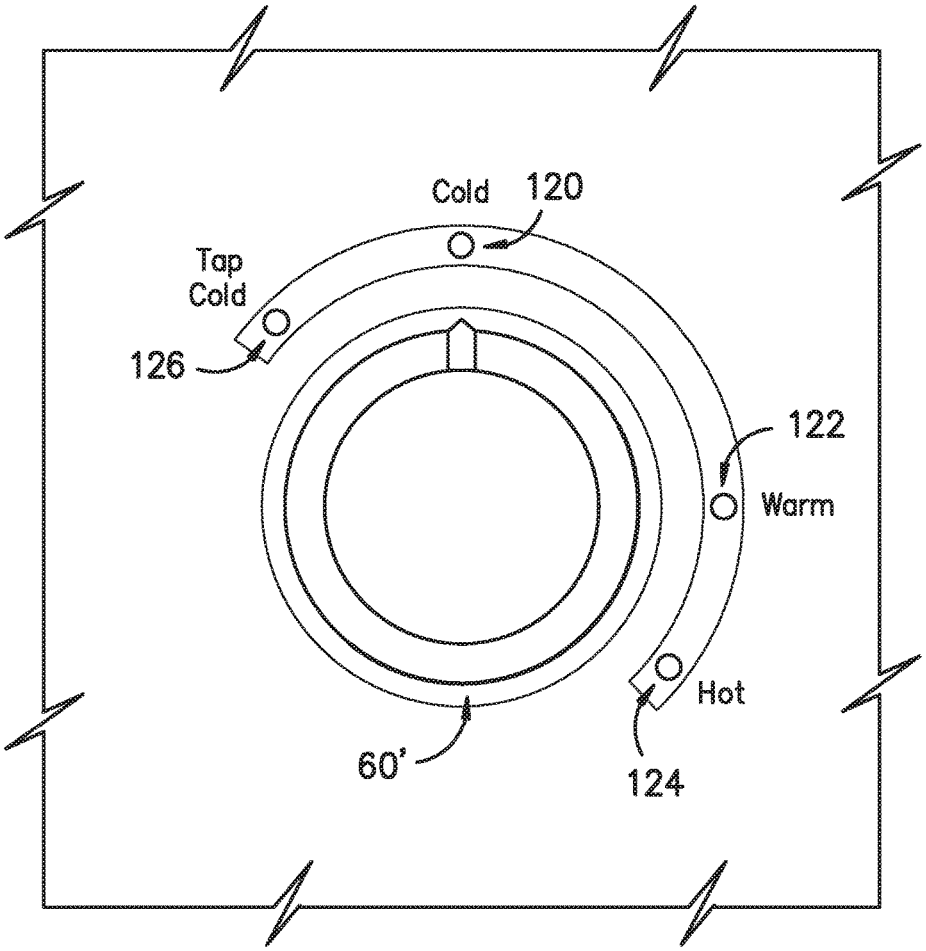
FIG. 3 provides a front view of a water temperature selector of a washing machine appliance in accordance with embodiments of the present disclosure.

Referring now to FIG. 3, one embodiment of a particular input selector 60, in this case a water temperature selector 60' is illustrated. The water temperature selector 60' provides various temperature options for a user to select. The temperature of water provided to the tub 64 may be based on the desired water temperature selection by a user through input to the water temperature selector 60'. For example, in some embodiments, the water temperature options from which a desired water temperature selection may be made include one or more regulated water temperatures. When a regulated water temperature is selected as a desired water temperature selection, water provided through valve assembly 74 is regulated by valve assembly 74 (via adjusting flow times and/or ratios of flow times for hot water from hot water source 76 and cold water from cold water source 75) such that the temperature of water provided to tub 64 (i.e. via nozzle 72) is at a particular predetermined temperature or within a particular predetermined temperature range.

For example, regulated water temperatures which may be utilized as water temperature options may include a regulated cold water temperature 120, a regulated warm water temperature 122 and/or a regulated hot water temperature 124. The regulated cold water temperature 120 may, for example, be between 60 degrees Fahrenheit and 68 degrees Fahrenheit, such as between 62 degrees Fahrenheit and 66 degrees Fahrenheit, such as between 64 degrees Fahrenheit and 65 degrees Fahrenheit. The regulated warm water temperature 122 may, for example, be between 70 degrees Fahrenheit and 90 degrees Fahrenheit, such as between 72 degrees Fahrenheit and 85 degrees Fahrenheit, such as between 74 degrees Fahrenheit and 80 degrees Fahrenheit. The regulated hot water temperature 124 may, for example, be between 95 degrees Fahrenheit and 135 degrees Fahrenheit, such as between 97 degrees Fahrenheit and 120 degrees Fahrenheit, such as between 100 degrees Fahrenheit and 110 degrees Fahrenheit.

Additionally or alternatively, in some embodiments, the water temperature options from which a desired water temperature selection may be made include an unregulated water temperature 126. When the unregulated water temperature 126 is selected as a desired water temperature selection, water provided through valve assembly 74 is initially provided only from the cold water source 75 with no regard for the temperature of the water being flowed through the valve assembly 74.

Figure 4:
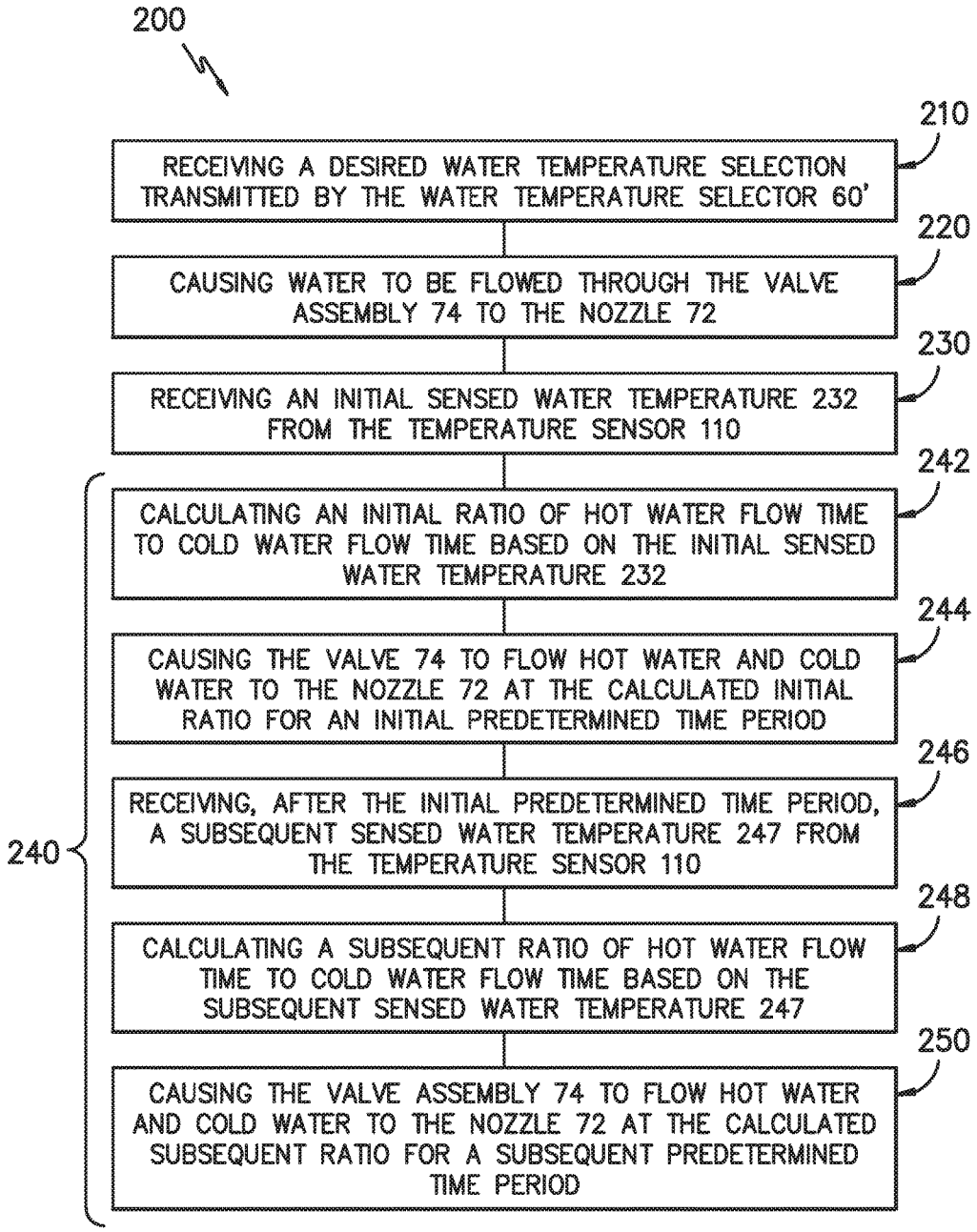
FIG. 4 provides a flow chart illustrating a method for operating a washing machine appliance in accordance with embodiments of the present disclosure.

Referring now to FIG. 4, various methods may be provided for use with washing machine appliances 50 in accordance with the present disclosure. In general, the various steps of methods as disclosed herein may in exemplary embodiments be performed by the controller 100, which may receive inputs and transmit outputs from various other components of the appliance 50. In particular, the present disclosure is further directed to methods, as indicated by reference number 200, for operating washing machine appliances 50.

Such methods (and operations of the controller 100) may advantageously provide "safety net" water temperature regulation when an unregulated water temperature 126 is chosen as the desired water temperature selection. In particular, when the unregulated water temperature 126 is chosen and the water flowing into the tub 64 and/or within the tub 64 is below a predetermined temperature threshold 202, regulation of the water temperature may occur such that the temperature of the water flowing into the tub 64 and/or within the tub 64 is raised, i.e. to at or above the predetermined temperature threshold 202.

The predetermined temperature threshold 202 may generally correspond to a temperature below which water can have adverse effects on the dispersion of additives (i.e. detergent, bleach, fabric softener, etc.), and thus have adverse effects on the performance of the washing machine appliance. Accordingly, methods (and operations of the controller 100) in accordance with the present disclosure improve such dispersion in cases wherein the unregulated water temperature 126 is below such threshold 202. The predetermined temperature threshold 202 may, for example, be between 55 degrees Fahrenheit and 90 degrees Fahrenheit, such as between 60 degrees Fahrenheit and 80 degrees Fahrenheit, such as between 65 degrees Fahrenheit and 70 degrees Fahrenheit.

A method 200 may, for example, include the step 210 of receiving a desired water temperature selection transmitted by the water temperature selector 60'. Accordingly, when a user selects a water temperature selection 60' as discussed herein, this selection may for example be transmitted to and received by controller 100. Such selection typically occurs before a wash cycle is commenced, and thus before water is flowed into the tub 64. Additional selections via other input selectors 60 (which may correspond to other various options for the wash cycle) may additionally be transmitted and received.

A method 200 may further include, for example, the step 220 of causing water to be flowed through the valve assembly 74 to the nozzle 72 (and thus through the nozzle 72 to the tub 64). For example, controller 100 may instruct the valve assembly 74 to open, such that water is flowed therethrough. As discussed herein, when the desired water temperature selection transmitted by the water temperature selector 60' is the unregulated water temperature 126, water may initially be flowed through the valve assembly 74 only from cold water source 75.

Method 200 may further include, for example, the step 230 of receiving an initial sensed water temperature 232 from the temperature sensor 110, such as after water begins to flow through valve as in step 220 and upon contact by the water with the temperature sensor 110. Accordingly, temperature sensor 110 may transmit and controller 100 may receive such initial sensed water temperature 232. Step 230 may in particular occur when the desired water temperature selection is the unregulated water temperature 126, as discussed herein.

Method 200 may further include, for example, the step 240 of causing the valve assembly 74 to adjust a temperature of the water flowed through the valve assembly 74. Such step 240 occurs when the desired water temperature selection is the unregulated water temperature 126 and the initial sensed water temperature 232 is below the predetermined temperature threshold 202. Accordingly, in cases wherein the desired water temperature selection is the unregulated water temperature 126, the initial sensed water temperature 232 may be compared to the predetermined temperature threshold 202 (i.e. via the controller 100) and the valve assembly 74 instructed to adjust the temperature of the water flowed therethrough if the initial sensed water temperature 232 is below the predetermined temperature threshold 202.

The adjustment of the temperature of the water flowed through the valve assembly 74 may generally be to increase such temperature. Adjustment of the temperature of the water flowed through the valve assembly 74 may thus be performed by the valve assembly 74 by generally allowing water from the hot water source 76 therethrough along with or instead of water from the cold water source 75. For example, step 240 may include adjusting a flow time for water from the hot water source 76, such as by increasing the flow time for water from the hot water source 76. Step 240 may further include, for example, adjusting a flow time for water from the cold water source 75, such as by decreasing the flow time for water from the cold water source 75. The flow time for water from the hot water source 76 or cold water source 75 is the amount of time, during the total time that water is being flowed into the tub 64 to a desired fill level (i.e. fill volume, fill height, etc.) at the beginning of the wash cycle, that such water is being supplied by the hot water source 76 or cold water source 75.

In exemplary embodiments, a relatively minimal amount of water from hot water source 76 is provided in accordance with step 240. For example, the minimal amount of water from hot water source 76 required to raise the water temperature flowing into or within the tub 64 to at or above the predetermined temperature threshold 202 may be utilized. Accordingly, controller 100 may for example, utilize particular algorithms to calculate the required hot water necessary for such water temperature adjustment. In exemplary embodiments, such calculations may be on an iterative basis, with adjustments in the flow time for hot water and cold water made before each of repeated predetermined time periods of water flow. The predetermined time periods may be portions of the total fill time. Each predetermined time period may for example be between 5 seconds and 30 seconds.

For example, step 240 may include the step 242 of calculating an initial ratio of hot water flow time to cold water flow time based on the initial sensed water temperature 232. The ratio may be a calculation of the relative times during which water from hot water source 76 and cold water source 75 respectively are allowed to flow through the valve assembly 74, in an effort to raise the water temperature as discussed herein. Step 240 may further include the step 244 of causing the valve assembly 74 to flow hot water and cold water to the nozzle 72 (as discussed herein) at the calculated initial ratio for an initial predetermined time period.

Further, calculation of the ratio and flowing of water based on the ratio may be repeated as necessary until, for example, the water temperature sensed by the temperature sensor 110 is at or above the predetermined temperature threshold 202. For example, step 240 may further include the step 246 of receiving, after the initial predetermined time period (and thus after step 244), a subsequent sensed water temperature 247 from the temperature sensor 110. Step 240 may further include the step 248 of calculating a subsequent ratio of hot water flow time to cold water flow time based on the subsequent sensed water temperature 247. Such step 240 may occur, for example, when the subsequent sensed water temperature 247 is below the predetermined temperature threshold 202. Step 240 may further include the step 250 of causing the valve assembly 74 to flow hot water and cold water to the nozzle 72 at the calculated subsequent ratio for a subsequent predetermined time period. Such steps 246, 248 and 250 may be repeated as necessary until the sensed water temperature is at or above the predetermined temperature threshold 202.

Various equations may be utilized to calculate the hot water flow times, cold water flow times, and/or ratios as required by steps 242 and/or 248. For example, in some embodiments, the following equation may be utilized:

$$T_{i+1} = \frac{(T_i)[(t_{h,i})(Q_h) + (t_{c,i})(Q_c)] + (T_{sensed})[(\Delta t_h)(Q_h) + (\Delta t_c)(Q_c)]}{(t_{h,i} + \Delta t_h)(Q_h) + (t_{c,i} + \Delta t_c)(Q_c)}$$

wherein $T_i$ is the initial sensed water temperature, $T_{sensed}$ is the most recently sensed water temperature, $T_{i+1}$ is the water temperature after a predetermined time period, $Q_h$ is the flow rate of hot water through valve assembly 74, $Q_c$ is the flow rate of cold water through valve assembly 74, $t_{h,i}$ is the total prior flow time of hot water during the flow of water into the tub 64, $t_{c,i}$ is the total prior flow time of cold water during the flow of water into the tub 64, $\Delta t_h$ is the hot water flow time for the upcoming predetermined time period, and $\Delta t_c$ is the cold water flow time for the upcoming predetermined time period. Notably, the flow rates of hot water and cold water can be assumed, or can be measure using for example a suitable flow meter. Such equation can, for example, be utilized to solve for the ratio of $\Delta t_h$ to $\Delta t_c$ for the upcoming predetermined time period. It should be understood, however that the present disclosure is not limited to the above-disclosed equation, and rather than any suitable equations are within the scope and spirit of the present disclosure.

As discussed, the temperature of the water flowed through the valve assembly 74 may be adjusted, i.e. raised, such that the sensed water temperature is at or above the predetermined temperature threshold 202. In some embodiments, such as when the temperature sensor 110 is in the tub 64, the volume of water within the tub 64 may thus reach the predetermined temperature threshold 202. In other embodiments, however, it may not be necessary for the entire volume of water within the tub 64 to reach this threshold 202. For example, as discussed, water may flow through additive dispenser 84 before being flowed into the tub 64. Accordingly, additive dispenser 84 may be disposed in the flow path of water between the valve assembly 74 and the nozzle 72. Further, temperature sensor 110 can be disposed in the flow path of water between the valve assembly 74 and the nozzle 72. Accordingly, in some embodiments, the temperature of the water flowed through the valve assembly 74 may be adjusted, i.e. raised, such that the sensed water temperature is at or above the predetermined temperature threshold 202 for a predetermined period of time or volume which allows for the dispensing of additives from the additive dispenser 84. After such predetermined period of time or volume, adjustment of the water temperature may no longer be required, and the water being flowed through valve assembly 74 may again be allowed to be at an unregulated water temperature 126.

It should be noted that methods in accordance with the present disclosure can occur at any period during a wash cycle wherein water is flowed into the appliance 50. For example, methods in accordance with the present disclosure can be utilized during flow of water into the appliance 50 before the agitation and/or rinse phase of the wash cycle. Further, if the water temperature for example does not reach the predetermined temperature threshold 202 despite use of methods in accordance with the present disclosure during one phase of the wash cycle (i.e. before the agitation cycle), this may cause the method to be repeated during a subsequent phase of the cycle (i.e. before the rinse cycle).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, the washing machine appliance comprising:

a cabinet;

a tub disposed within the cabinet;

a basket disposed within the tub and rotatable relative to the tub about a central axis;

a nozzle operable to flow water into the tub;

a valve assembly operable to regulate the flow of water to the nozzle, the valve assembly in fluid communication with a hot water source and a cold water source;

a temperature sensor for sensing a water temperature;

a control panel, the control panel comprising a water temperature selector;

an additive dispenser in fluid communication with the nozzle; and a controller in communication with the valve assembly, the temperature sensor and the water temperature selector, the controller configured to execute:

receiving a desired water temperature selection transmitted by the water temperature selector;

causing water to be flowed through the valve assembly to the nozzle;

receiving, when the desired water temperature selection is an unregulated water temperature, an initial sensed water temperature from the temperature sensor; and causing the valve assembly to adjust a temperature of the water flowed through the valve assembly and directing the water through the additive dispenser when the desired water temperature selection is an unregulated water temperature and the initial sensed water temperature is below a predetermined temperature threshold, wherein causing the valve assembly to adjust the temperature comprises dispensing additives from the additive dispenser with the water flowed therethrough at a temperature above the initial sensed temperature;

wherein causing the valve assembly to adjust the temperature of the water flowed through the valve assembly comprises flowing water for a predetermined temperature-adjusting time period according to a calculated ratio of a hot water flow time and a cold water flow time, wherein the calculated ratio is determined from an equation embodied as $$T_{i+1} = \frac{(T_i)[(t_{h,i})(Q_h) + (t_{c,i})(Q_c)] + (T_{sensed})[(\Delta t_h)(Q_h) + (\Delta t_c)(Q_c)]}{(t_{h,i} + \Delta t_h)(Q_h) + (t_{c,i} + \Delta t_c)(Q_c)}$$

wherein $T_i$ is the initial sensed water temperature, $T_{sensed}$ is a sensed water temperature from the temperature sensor after the initial sensed water temperature, $T_{i+1}$ is a water temperature after an initial predetermined time period before the initial sensed water temperature, $Q_h$ is a previously-measured flow rate of hot water through the valve assembly, $Q_c$ is a previously-measured flow rate of cold water through the valve assembly, $t_{h,i}$ is a total prior flow time of hot water during the flow of water to the nozzle, $t_{c,i}$ is a total prior flow time of cold water during the flow of water to the nozzle, $\Delta t_h$ is the hot water flow time for the predetermined temperature-adjusting time period, and $\Delta t_c$ is the cold water flow time for the predetermined temperature-adjusting time period.

2. The washing machine appliance of claim 1, wherein causing the valve assembly to adjust the temperature of the water flowed through the valve assembly further comprises:

receiving, after the initial predetermined time period, a subsequent sensed water temperature from the temperature sensor;

calculating a subsequent ratio of hot water flow time to cold water flow time based on the subsequent sensed water temperature; and causing the valve assembly to flow hot water and cold water to the nozzle at the calculated subsequent ratio for a subsequent predetermined time period.

3. The washing machine appliance of claim 1, wherein the predetermined temperature threshold is between 55 degrees Fahrenheit and 90 degrees Fahrenheit.

4. The washing machine appliance of claim 1, wherein the predetermined temperature threshold is between 60 degrees Fahrenheit and 80 degrees Fahrenheit.

5. The washing machine appliance of claim 1, wherein the desired water temperature selection is one of the unregulated water temperature or a regulated water temperature.

6. The washing machine appliance of claim 1, wherein the desired water temperature selection is one of the unregulated water temperature, a regulated cold water temperature, a regulated warm water temperature, or a regulated hot water temperature.

7. The washing machine appliance of claim 6, wherein the regulated cold water temperature is between 60 degrees Fahrenheit and 68 degrees Fahrenheit, the regulated warm water temperature is between 70 degrees Fahrenheit and 90 degrees Fahrenheit, and the regulated hot water temperature is between 95 degrees Fahrenheit and 135 degrees Fahrenheit.

8. The washing machine appliance of claim 1, wherein the temperature sensor is disposed within the tub.

9. The washing machine appliance of claim 1, wherein the temperature sensor is a thermistor.

10. A method for operating a washing machine appliance, the method comprising:

receiving a desired water temperature selection;

causing water to be flowed through a valve assembly to a nozzle, the nozzle operable to flow water into a tub of the washing machine appliance;

receiving, when the desired water temperature selection is an unregulated water temperature, an initial sensed water temperature from a temperature sensor; and causing the valve assembly to adjust a temperature of the water flowed through the valve assembly when the desired water temperature selection is an unregulated water temperature and the initial sensed water temperature is below a predetermined temperature threshold, wherein causing the valve assembly to adjust the temperature of the water flowed through the valve assembly comprises flowing water for a predetermined temperature-adjusting time period according to a calculated ratio of a hot water flow time and a cold water flow time, wherein the calculated ratio is determined from an equation embodied as $$T_{i+1} = \frac{(T_i)[(t_{h,i})(Q_h) + (t_{c,i})(Q_c)] + (T_{sensed})[(\Delta t_h)(Q_h) + (\Delta t_c)(Q_c)]}{(t_{h,i} + \Delta t_h)(Q_h) + (t_{c,i} + \Delta t_c)(Q_c)}$$

wherein $T_i$ is the initial sensed water temperature, $T_{sensed}$ is a sensed water temperature from the temperature sensor after the initial sensed water temperature, $T_{i+1}$ is a water temperature after an initial predetermined time period before the initial sensed water temperature, $Q_h$ is a previously-measured flow rate of hot water through the valve assembly, $Q_c$ is a previously-measured flow rate of cold water through the valve assembly, $t_{h,i}$ is a total prior flow time of hot water during the flow of water to the nozzle, $t_{c,i}$ is a total prior flow time of cold water during the flow of water to the nozzle, $\Delta t_h$ is the hot water flow time for the predetermined temperature-adjusting time period, and $\Delta t_c$ is the cold water flow time for the predetermined temperature-adjusting time period.

11. The method of claim 10, wherein causing the valve assembly to adjust the temperature of the water flowed through the valve assembly further comprises:

receiving, after the initial predetermined time period, a subsequent sensed water temperature from the temperature sensor;

calculating a subsequent ratio of hot water flow time to cold water flow time based on the subsequent sensed water temperature;

causing the valve assembly to flow hot water and cold water to the nozzle at the calculated subsequent ratio for a subsequent predetermined time period.

12. The method of claim 10, wherein the predetermined temperature threshold is between 55 degrees Fahrenheit and 90 degrees Fahrenheit.

13. The method of claim 10, wherein the desired water temperature selection is one of the unregulated water temperature or a regulated water temperature.

* * * * *